US012539010B2

(12) United States Patent
Guezo

(10) Patent No.: US 12,539,010 B2
(45) Date of Patent: Feb. 3, 2026

(54) DOUBLE ACTION WRINGER ASSEMBLY

(71) Applicant: Desire Guezo, Bronx, NY (US)

(72) Inventor: Desire Guezo, Bronx, NY (US)

( * ) Notice: Subject to any disclaimer, the term of this patent is extended or adjusted under 35 U.S.C. 154(b) by 417 days.

(21) Appl. No.: 18/210,405

(22) Filed: Jun. 15, 2023

(65) Prior Publication Data

US 2024/0074637 A1 Mar. 7, 2024

Related U.S. Application Data

(63) Continuation-in-part of application No. 17/235,310, filed on Apr. 20, 2021, now abandoned.

(51) Int. Cl.
*A47L 13/59* (2006.01)

(52) U.S. Cl.
CPC ..... *A47L 13/59* (2013.01)

(58) Field of Classification Search
CPC ..... A47L 13/58; A47L 13/59
USPC ..... 15/261, 264
See application file for complete search history.

(56) References Cited

U.S. PATENT DOCUMENTS

| | | | | |
|---|---|---|---|---|
| 1,500,058 | A | 7/1924 | Courtemanche | |
| 2,099,217 | A | 11/1937 | Newland | |
| D305,170 | S | 12/1989 | Jaros | |
| 4,905,339 | A | 3/1990 | Taylor | |
| 5,440,778 | A | 8/1995 | De Guzman | |
| 6,487,749 | B1 | 12/2002 | Tsui | |
| 7,225,499 | B1 * | 6/2007 | Duncan | A47L 13/59 15/264 |
| D548,913 | S | 8/2007 | Van Landingham, Jr. | |
| 7,350,260 | B2 | 4/2008 | Papa | |

* cited by examiner

*Primary Examiner* — Tom Rodgers

(57) ABSTRACT

A double action wringer assembly for wringing a mop in a mop bucket includes a mop bucket and a wringer that is positioned on the mop bucket. A handle is included that has a pair of legs each extending between a grip such that the handle has a U-shape. The handle is movably integrated into the wringer for wringing the mop. A foot pedal is movably disposed on the mop bucket and the foot pedal can be stepped upon. Additionally, the foot pedal is in mechanical communication with the wringer. The foot pedal urges the wringer into the compressed condition when the foot pedal is stepped upon to wring the mop.

6 Claims, 5 Drawing Sheets

DOUBLE ACTION WRINGER ASSEMBLY

CROSS-REFERENCE TO RELATED APPLICATIONS

I hereby claim the benefit under 35 U.S.C., Section 120 of U.S. application Ser. No. 17/235,310 filed Apr. 20, 2021.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wringer devices and more particularly pertains to a new wringer device for wringing a mop in hands-free manner. The device includes a wringer that includes a handle that includes a pair of legs to enhance stability of the handle. The device includes a foot pedal that is coupled to the wringer for hands-free actuation of the wringer.

(2) Description of Related Art Including Information Disclosed Under 37 CFR 1.97 and 1.98

The prior art relates to wringer devices including a variety of mop wringers that include a foot pedal. Additionally, the prior art discloses a variety of wringer devices that include a handle for hand actuating. The prior art discloses a wringer device that has a handle which includes a pair of legs. In no instance does the prior art disclose a wringer device that has a foot pedal and a handle which includes a pair of legs.

BRIEF SUMMARY OF THE INVENTION

An embodiment of the disclosure meets the needs presented above by generally comprising a mop bucket and a wringer that is positioned on the mop bucket. A handle is included that has a pair of legs each extending between a grip such that the handle has a U-shape. The handle is movably integrated into the wringer for wringing the mop. A foot pedal is movably disposed on the mop bucket and the foot pedal can be stepped upon. Additionally, the foot pedal is in mechanical communication with the wringer. The foot pedal urges the wringer into the compressed condition when the foot pedal is stepped upon to wring the mop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
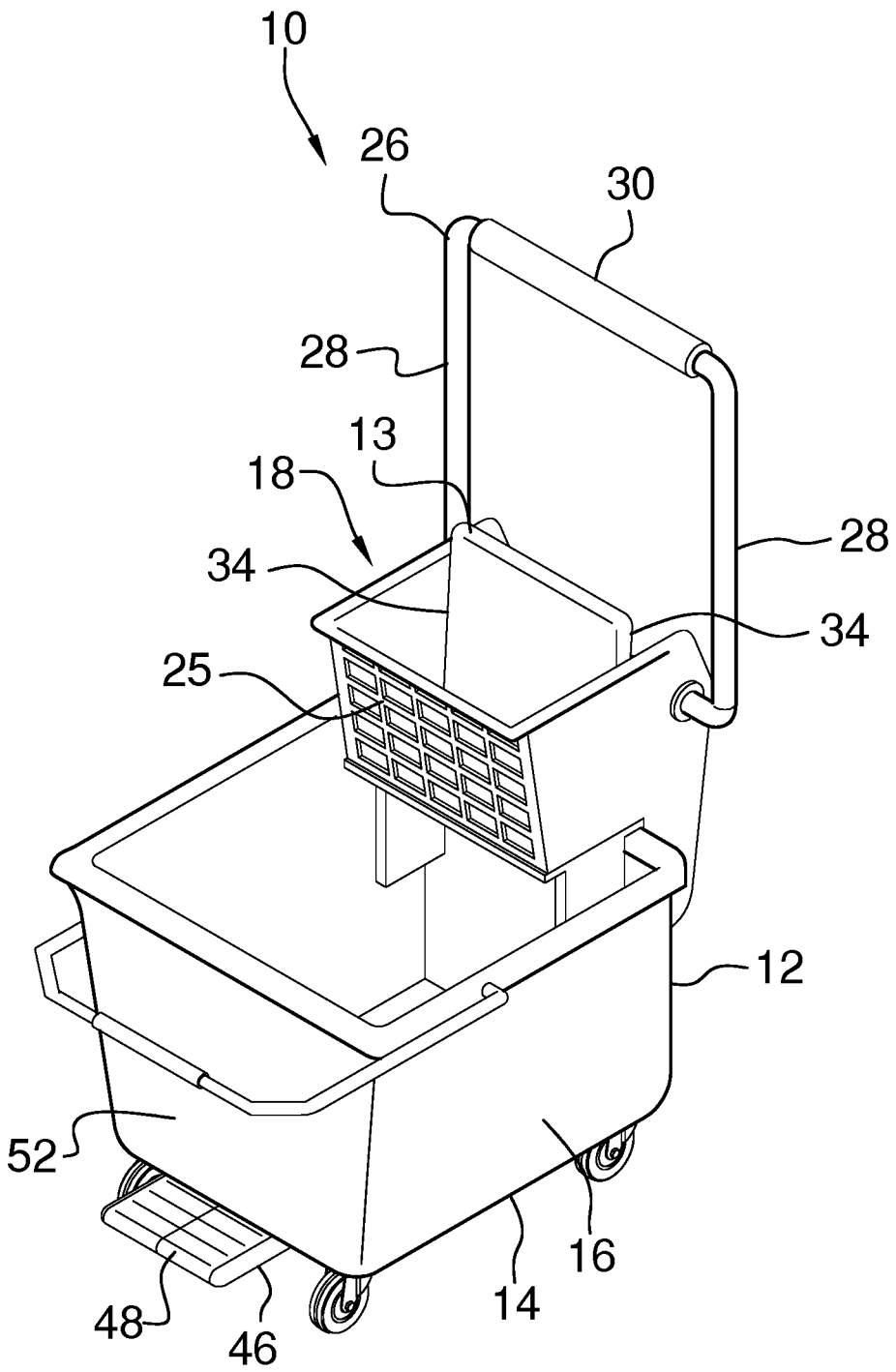
FIG. 1 is a top perspective view of a double action wringer assembly according to an embodiment of the disclosure.
Figure 2:
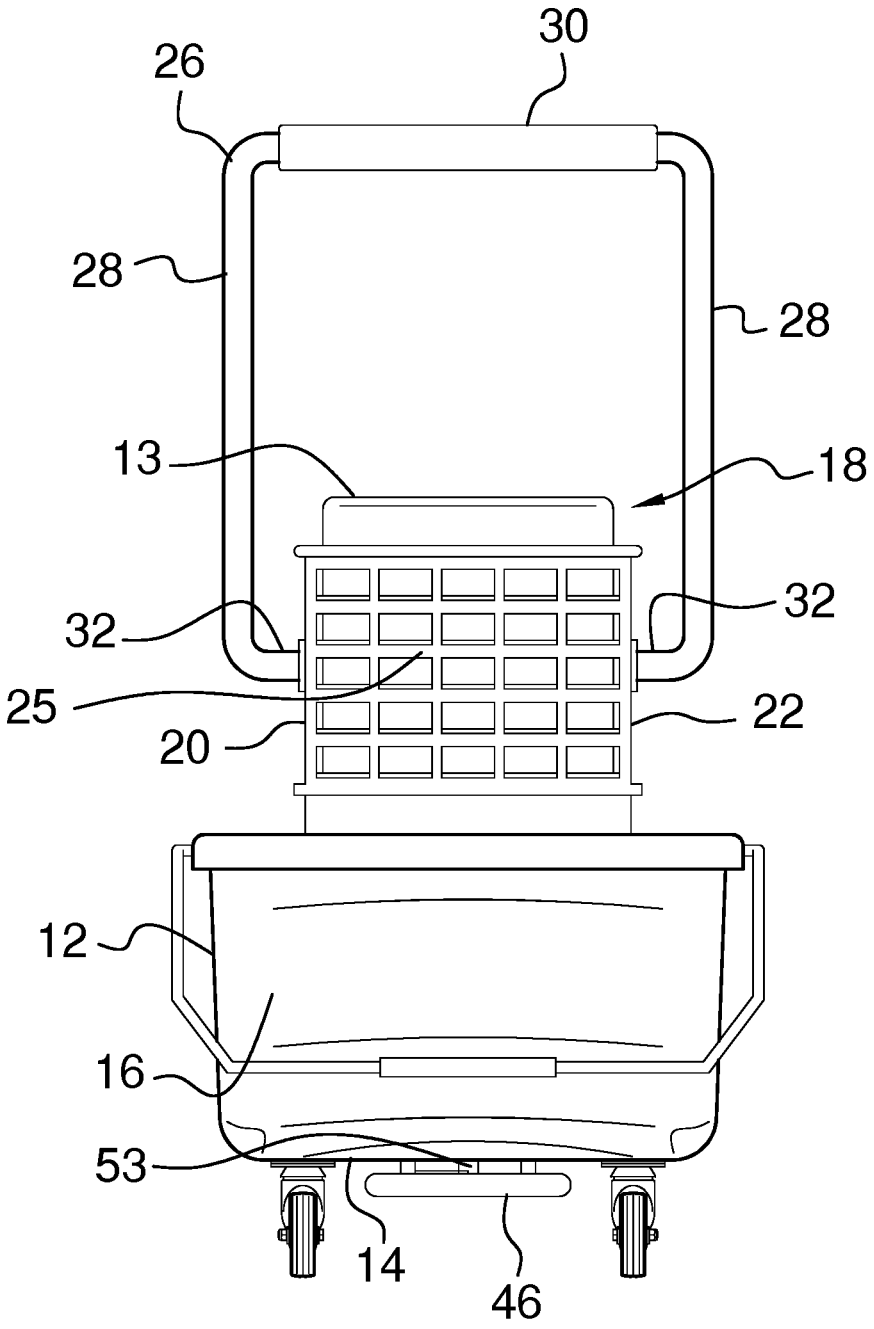
FIG. 2 is a front view of an embodiment of the disclosure.
Figure 3:
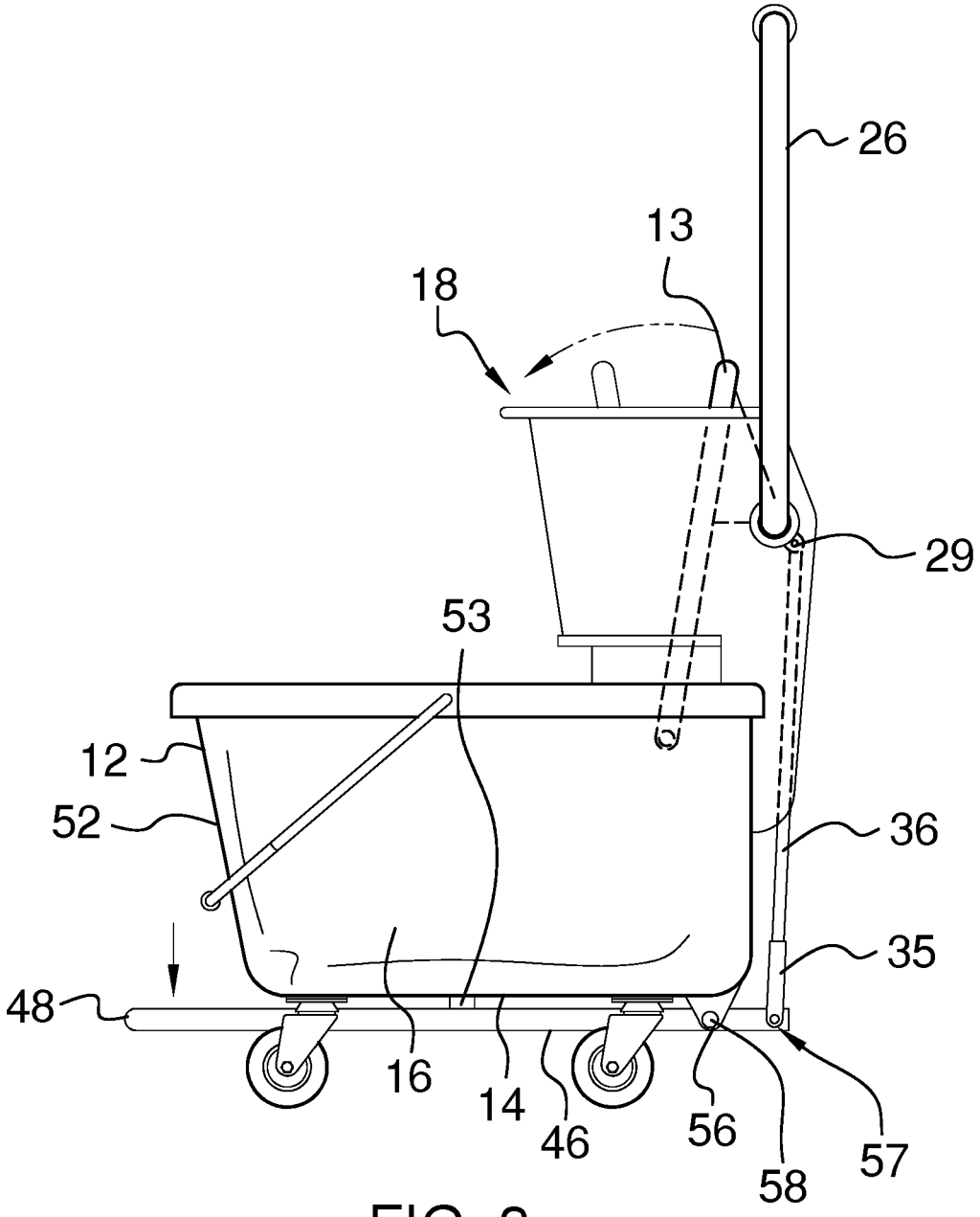
FIG. 3 is a left side view of an embodiment of the disclosure.
Figure 4:
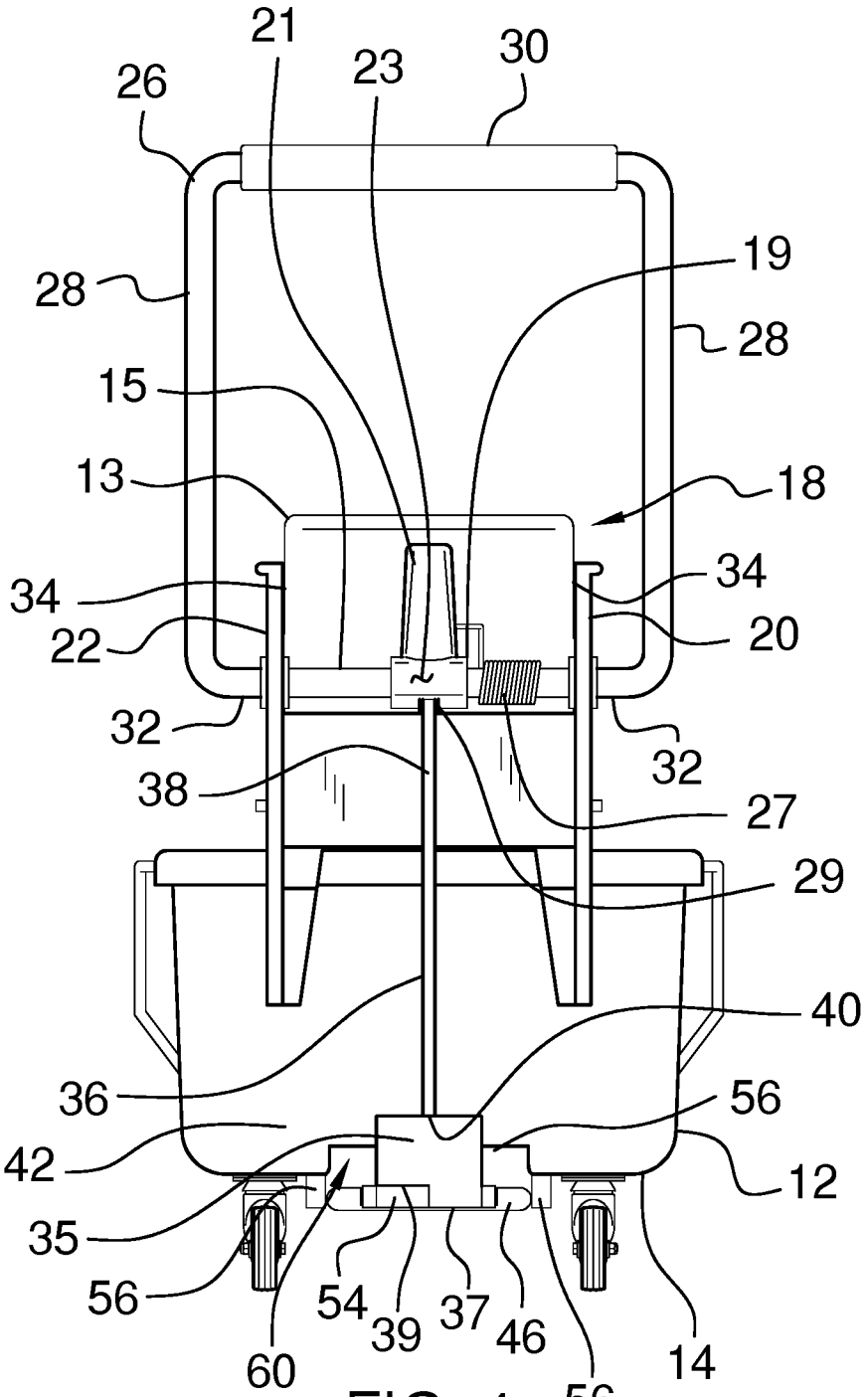
FIG. 4 is a back view of an embodiment of the disclosure.
Figure 5:
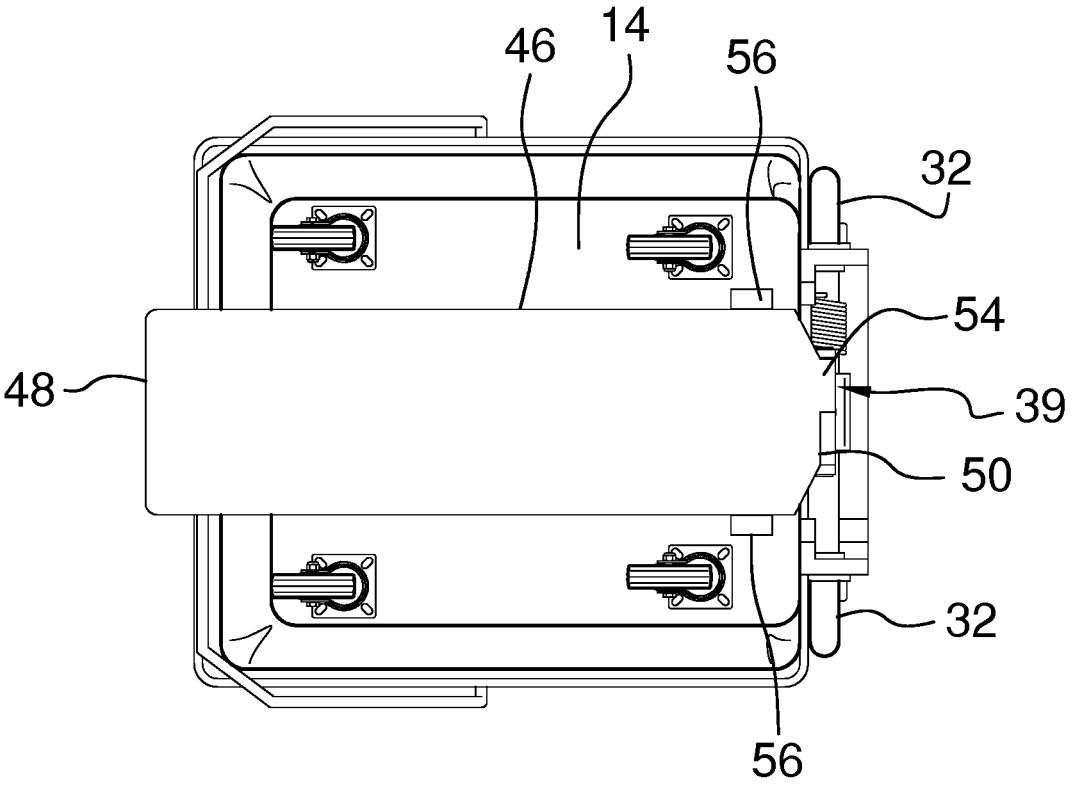
FIG. 5 is a bottom view of an embodiment of the disclosure.

With reference now to the drawings, and in particular to FIGS. 1 through 5 thereof, a new wringer device embodying the principles and concepts of an embodiment of the disclosure and generally designated by the reference numeral 10 will be described.

As best illustrated in FIGS. 1 through 5, the double action wringer assembly 10 generally comprises a mop bucket 12 that has a bottom wall 14 and an outer wall 16 extending upwardly from the bottom wall 14. The mop bucket 12 may be a commercial mop bucket of any conventional design. A wringer 18 is positioned on the mop bucket 12 which can have a mop positioned therein for squeezing water from the mop. The wringer 18 may be a commercial mop wringer of any conventional design. The wringer 18 has a first lateral wall 20 and a second lateral wall 22 and the wringer 18 includes a plate 13 that is pivotally disposed in the wringer 18. The wringer 18 includes a rod 15 extending along a back surface 17 of the plate 13 and the rod 15 extends between the first lateral wall 20 and the second lateral wall 22 of the wringer 18. The wringer 18 includes a collar 19 that is positioned around the rod 15 and the collar 19 is rotatable in a first direction or a second direction around the rod 15.

The wringer 18 includes a finger 21 which extends away from an outside surface 23 of the collar 19 and the finger 21 extends upwardly along the back surface 17 of the plate 13. The finger 21 urges the plate 13 forwardly toward a front wall 25 of the wringer 18 when the collar 19 rotates in the first direction. In this way the plate 13 can squeeze the mop between the plate 13 and the front wall 25 of the wringer 18. The wringer 18 includes a biasing member 27 that is wrapped around the rod 15 and engages the finger 21 such that the biasing member 27 biases the collar 19 to rotate in the second direction thereby urging the finger 21 away from the plate 13. The front wall 25 of the wringer 18 may be foraminous to facilitate water to pass through the front wall 25. The collar 19 includes a pivot point 29 extending away from the outside surface 23 of the collar 19.

A handle 26 is provided and the handle 26 has a pair of legs 28 each extending between a grip 30 such that the handle 26 has a U-shape. The handle 26 is movably integrated into the wringer 18 and the handle 26 can be gripped for wringing the mop. The handle 26 urges the wringer 18 into a compressed condition and the wringer 18 is biased into a released condition. Each of the legs 28 has a foot 32 extending away from the leg 28, and the foot 32 on each of the legs 28 is directed toward each other. The foot 32 on each of the legs 28 rotatably engages a respective one of the first lateral wall 20 and the second lateral wall 22 of the wringer 18. Each of the legs 28 is vertically oriented when the wringer 18 is in the released condition and the grip 30 extends along a horizontal axis for gripping.

A motion arm 36 is coupled to and extends downwardly from the wringer 18. The motion arm 36 has an upper end 38 and a lower end 40 the upper end 38 is pivotally coupled to the pivot point 29 on the outside surface 23 of the collar 19. The upper end 38 may be pivotally coupled to the pivot point 29 with a pin, a yoke or other type of pivotable coupling. The motion arm 36 has a panel 35 is disposed on the lower end 40 of the motion arm 36. The panel 35 has a lower edge 37 and the lower edge 37 has a notch 39 extending upwardly toward the lower end 40 of the motion arm 36. The motion arm 36 extends downwardly along a back side 42 of the outer wall 16 of the mop bucket 12.

A foot pedal 46 is movably disposed on the mop bucket 12 such that the foot pedal 46 can be stepped upon. The foot pedal 46 is in mechanical communication with the wringer 18 and the foot pedal 46 urges the wringer 18 into the compressed condition when the foot pedal 46 is stepped upon. In this way the foot pedal 46 can wring the mop in lieu of the handle 26. The foot pedal 46 has a front end 48 and a back end 50, and the foot pedal 46 is elongated between the front end 48 and the back end 50. The foot pedal 46 extends along the bottom wall 14 of the mop bucket 12 such that the front end 48 is spaced in front of a front side 52 of the outer wall 16 of the mop bucket 12. A biasing member 53 is attached between the foot pedal 46 and the bottom wall 14 of the mop bucket 12 which biases the foot pedal 46 toward the bottom wall 14 when the foot pedal 46 is not being stepped upon.

The back end 50 of the foot pedal 46 has a tab 54 extending away from the back end 50, and the tab 54 is positioned in the notch 39 in the lower edge 37 of the panel 35 on motion arm 36. A pin 55 extends through the tab 54 and the panel 35 to pivotally attach the foot pedal 46 to the panel 35. A pair of pivots 56 is each coupled to the bottom wall 14 of the mop bucket 12 and foot pedal 46 is positioned between the pivots 56. The pair of pivots 56 includes a pin 58 that extends through the foot pedal 46 at a point that is positioned closer to the back end 50 of the foot pedal 46 than front end 48 of the foot panel 35. In this way the foot pedal 46 is pivotally coupled to the pivots 56 such that the back end 50 of the food pedal 46 is urged upwardly when the front end 48 of the foot pedal 46 is stepped upon. As is most clearly shown in FIG. 4, the bottom wall 14 of the mop bucket 12 has a recess 60 that intersects the back side 42 of the outer wall 16 of the mop bucket 12 to facilitate clearance for the foot pedal 46 to fully pivot.

In use, the pair of legs 28 in the handle 26 facilitates the handle 26 to be manipulated from either the left side or the right side of the wringer 18. In this way the handle 26 improves the function of the wringer 18. The foot pedal 46 can be stepped upon to urge the wringer 18 into the compressed position. In this way the wringer 18 can be actuated in a hands-free manner to wring the mop. Thus, the structure of the handle 26 and the foot pedal 46 improve the function of the wringer 18 compared to a traditional mop wringer.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A double action wringer assembly being integrated into a mop bucket to facilitate either hand actuation or foot actuation, said assembly comprising:

a mop bucket;

a wringer being positioned on said mop bucket wherein said wringer is configured to have a mop positioned therein for squeezing water from the mop;

a handle having a pair of legs each extending between a grip such that said handle has a U-shape, said handle being movably integrated into said wringer wherein said handle is configured to be gripped for wringing the mop, said handle urging said wringer into a compressed condition, said wringer being biased into a released condition; and a foot pedal being movably disposed on said mop bucket wherein said foot pedal is configured to be stepped upon, said foot pedal being in mechanical communication with said wringer, said foot pedal urging said wringer into said compressed condition when said foot pedal is stepped upon wherein said foot pedal is configured to wring the mop;

wherein said wringer includes:

a plate being pivotally disposed in said wringer;

a rod extending along a back surface of said plate, said rod extending between a first lateral wall and a second lateral wall of said wringer;

a collar being positioned around said rod, said collar being rotatable in a first direction or a second direction around said rod, said collar having a pivot point extending away from an outside surface of said collar;

a finger extending away from said outside surface of said collar, said finger extending upwardly along said back surface of said plate, said finger urging said plate forwardly toward said front wall of said wringer when said collar rotates in said first direction wherein said plate is configured to squeeze the mop between said plate and said front wall of said wringer; and a biasing member being wrapped around said rod and engaging said finger such that said biasing member biases said collar to rotate in said second direction thereby urging said finger away from said plate;

wherein said assembly includes a motion arm being coupled to and extending downwardly from said wringer, said motion arm having an upper end and a lower end, said upper end being pivotally coupled to said pivot point on said outside surface of said collar, said motion arm extending downwardly along a back side of said outer wall of said mop bucket, said motion arm having a panel being disposed on said lower end of said motion arm, said panel having a lower edge, said lower edge having a notch extending upwardly toward said lower end of said motion arm.

2. The assembly according to claim 1, wherein:

said wringer has a first lateral wall and a second lateral wall;

each of said legs has a foot extending away from said leg, said foot on each of said legs being directed toward each other, said foot on each of said legs rotatably engaging a respective one of said first lateral wall and said second lateral wall of said wringer, each of said legs being vertically oriented when said wringer is in said released condition having said grip extending along a horizontal axis wherein said grip is configured to be gripped.

3. The assembly according to claim 1, wherein:

said mop bucket has a bottom wall and an outer wall extending upwardly from said bottom wall; and said foot pedal has a front end and a back end, said foot pedal being elongated between said front end and said back end, said foot pedal extending along said bottom wall of said mop bucket such that said front end is spaced in front of a front side of said outer wall of said mop bucket, said back end having a tab extending away from said back end, said tab being positioned in said notch in said lower edge of said panel on said lower end of said motion arm.

4. The assembly according to claim 3, further comprising a pair of pivots, each of said pivots being coupled to said bottom wall of said mop bucket, said foot pedal being positioned between said pivots, said pair of pivots including a pin extending through said foot pedal at a point positioned closer to said back end of said foot pedal than said front end of said foot pedal for pivotally attaching said foot pedal to said pivots such that said back end of said foot pedal is urged upwardly when said front end of said foot pedal is stepped upon thereby lifting said motion arm.

5. A double action wringer assembly being integrated into a mop bucket to facilitate either hand actuation or foot actuation, said assembly comprising:

a mop bucket having a bottom wall and an outer wall extending upwardly from said bottom wall;

a wringer being positioned on said mop bucket wherein said wringer is configured to have a mop positioned therein for squeezing water from the mop, said wringer having a first lateral wall, a second lateral wall and a front wall, said wringer including:

a plate being pivotally disposed in said wringer;

a rod extending along a back surface of said plate, said rod extending between said first lateral wall and said second lateral wall of said wringer;

a collar being positioned around said rod, said collar being rotatable in a first direction or a second direction around said rod, said collar having a pivot point extending away from an outside surface of said collar;

a finger extending away from an outside surface of said collar, said finger extending upwardly along said back surface of said plate, said finger urging said plate forwardly toward said front wall of said wringer when said collar rotates in said first direction wherein said plate is configured to squeeze the mop between said plate and said front wall of said wringer; and a biasing member being wrapped around said rod and engaging said finger such that said biasing member biases said collar to rotate in said second direction thereby urging said finger away from said plate;

a handle having a pair of legs each extending between a grip such that said handle has a U-shape, said handle being movably integrated into said wringer wherein said handle is configured to be gripped for wringing the mop, said handle urging said wringer into a compressed condition, said wringer being biased into a released condition, each of said legs having a foot extending away from said leg, said foot on each of said legs being directed toward each other, said foot on each of said legs rotatably engaging a respective one of said first lateral wall and said second lateral wall of said wringer, each of said legs being vertically oriented when said wringer is in said released condition having said grip extending along a horizontal axis wherein said grip is configured to be gripped;

a motion arm being coupled to and extending downwardly from said wringer, said motion arm having an upper end and a lower end, said upper end being pivotally coupled to said pivot point on said outside surface of said collar, said motion arm extending downwardly along a back side of said outer wall of said mop bucket, said motion arm having a panel being disposed on said lower end of said motion arm, said panel having a lower edge, said lower edge having a notch extending upwardly toward said lower end of said motion arm;

a foot pedal being movably disposed on said mop bucket wherein said foot pedal is configured to be stepped upon, said foot pedal being in mechanical communication with said wringer, said foot pedal urging said wringer into said compressed condition when said foot pedal is stepped upon wherein said foot pedal is configured to wring the mop, said foot pedal having a front end and a back end, said foot pedal being elongated between said front end and said back end, said foot pedal extending along said bottom wall of said mop bucket such that said front end is spaced in front of a front side of said outer wall of said mop bucket, said back end having a tab extending away from said back end, said tab being positioned in said notch in said lower edge of said panel on said lower end of said motion arm;

a pin extending through said tab and said panel for pivotally attaching said tab to said panel;

a biasing member being attached between said foot pedal and said bottom wall of said mop bucket, said biasing member biasing said foot pedal upwardly toward said bottom wall when said foot pedal is not being stepped upon; and a pair of pivots, each of said pivots being coupled to said bottom wall of said mop bucket, said foot pedal being positioned between said pivots, said pair of pivots including a pin extending through said foot pedal at a point positioned closer to said back end of said foot pedal than said front end of said foot pedal for pivotally attaching said foot pedal to said pivots such that said back end of said foot pedal is urged upwardly when said front end of said foot pedal is stepped upon thereby lifting said motion arm.

6. A double action wringer system being integrated into a mop bucket to facilitate either hand actuation or foot actuation, said system comprising:

a mop bucket having a bottom wall and an outer wall extending upwardly from said bottom wall;

a wringer being positioned on said mop bucket wherein said wringer is configured to have a mop positioned therein for squeezing water from the mop, said wringer having a first lateral wall, a second lateral wall and a front wall, said wringer including:

a plate being pivotally disposed in said wringer;

a rod extending along a back surface of said plate, said rod extending between said first lateral wall and said second lateral wall of said wringer;

a collar being positioned around said rod, said collar being rotatable in a first direction or a second direction around said rod, said collar having a pivot point extending away from an outside surface of said collar;

a finger extending away from an outside surface of said collar, said finger extending upwardly along said back surface of said plate, said finger urging said plate forwardly toward said front wall of said wringer when said collar rotates in said first direction wherein said plate is configured to squeeze the mop between said plate and said front wall of said wringer; and a biasing member being wrapped around said rod and engaging said finger such that said biasing member biases said collar to rotate in said second direction thereby urging said finger away from said plate;

a handle having a pair of legs each extending between a grip such that said handle has a U-shape, said handle being movably integrated into said wringer wherein said handle is configured to be gripped for wringing the mop, said handle urging said wringer into a compressed condition, said wringer being biased into a released condition, each of said legs having a foot extending away from said leg, said foot on each of said legs being directed toward each other, said foot on each of said legs rotatably engaging a respective one of said first lateral wall and said second lateral wall of said wringer, each of said legs being vertically oriented when said wringer is in said released condition having said grip extending along a horizontal axis wherein said grip is configured to be gripped;

a motion arm being coupled to and extending downwardly from said wringer, said motion arm having an upper end and a lower end, said upper end being pivotally coupled to said pivot point on said outside surface of said collar, said motion arm extending downwardly along a back side of said outer wall of said mop bucket, said motion arm having a panel being disposed on said lower end of said motion arm, said panel having a lower edge, said lower edge having a notch extending upwardly toward said lower end of said motion arm;

a foot pedal being movably disposed on said mop bucket wherein said foot pedal is configured to be stepped upon, said foot pedal being in mechanical communication with said wringer, said foot pedal urging said wringer into said compressed condition when said foot pedal is stepped upon wherein said foot pedal is configured to wring the mop, said foot pedal having a front end and a back end, said foot pedal being elongated between said front end and said back end, said foot pedal extending along said bottom wall of said mop bucket such that said front end is spaced in front of a front side of said outer wall of said mop bucket, said back end having a tab extending away from said back end, said tab being positioned in said notch in said lower edge of said panel on said lower end of said motion arm;

a pin extending through said tab and said panel for pivotally attaching said tab to said panel;

a biasing member being attached between said foot pedal and said bottom wall of said mop bucket, said biasing member biasing said foot pedal upwardly toward said bottom wall when said foot pedal is not being stepped upon; and a pair of pivots, each of said pivots being coupled to said bottom wall of said mop bucket, said foot pedal being positioned between said pivots, said pair of pivots including a pin extending through said foot pedal at a point positioned closer to said back end of said foot pedal than said front end of said foot pedal for pivotally attaching said foot pedal to said pivots such that said back end of said foot pedal is urged upwardly when said front end of said foot pedal is stepped upon thereby lifting said motion arm.

* * * * *